US008110795B2

(12) United States Patent
Haase et al.

(10) Patent No.: US 8,110,795 B2
(45) Date of Patent: Feb. 7, 2012

(54) LASER SYSTEM FOR MALDI MASS SPECTROMETRY

(75) Inventors: Andreas Haase, Bremen (DE); Jens Höhndorf, Bremen (DE); Jochen Franzen, Bremen (DE)

(73) Assignee: Brucker Daltonik GmbH, Bremen (DE)

( * ) Notice: Subject to any disclaimer, the term of this patent is extended or adjusted under 35 U.S.C. 154(b) by 96 days.

(21) Appl. No.: 12/716,813

(22) Filed: Mar. 3, 2010

(65) Prior Publication Data

US 2010/0224775 A1 Sep. 9, 2010

(30) Foreign Application Priority Data

Mar. 4, 2009 (DE) ..... 10 2009 011 653

(51) Int. Cl.
*H01J 49/26* (2006.01)
*H01J 49/02* (2006.01)

(52) U.S. Cl. ..... 250/282; 250/287; 250/288

(58) Field of Classification Search ..... 250/281, 250/282, 287, 288, 299, 390.07, 390.08, 250/423 R, 424, 425
See application file for complete search history.

(56) References Cited

U.S. PATENT DOCUMENTS 6,300,627 B1 10/2001 Koster et al.
6,558,902 B1 5/2003 Hillenkamp
7,235,781 B2 6/2007 Haase et al.
7,396,686 B2 7/2008 Suckau et al.
2004/0089804 A1* 5/2004 Dantus et al. ..... 250/288
2006/0187974 A1* 8/2006 Dantus ..... 372/9
2009/0321626 A1* 12/2009 Vertes et al. ..... 250/282
2010/0237238 A1* 9/2010 Franzen ..... 250/283

FOREIGN PATENT DOCUMENTS

JP 2005030915 2/2005

OTHER PUBLICATIONS

Dreisewerd et al. "Matrix-Assisted Laser Desorption/Ionization with Nitrogen Lasers of Different Pulse Widths", International Journal of Mass Spectrometry and Ion Processes, vol. 154, pp. 171-178, 1996.
Menzel et al. "The Role of Laser Pulse Duration in Infrared Matrix-Assisted Laser Desorption/Ionization Mass Spectrometry", Journal Am. Soc. Mass Spectrom., vol. 13, pp. 975-984, 2002.
Meffert et al. "Dissociative Proton Transfer in Cluster Ions: Clusters of Aromatic Carboxylic Acids with Amino Acids", International Journal of Mass Spectrometry, vol. 210/211, pp. 521-530, 2001.
Dreisewerd, Klaus, "The Desorption Process in MALDI", Chem. Rev. 2003, 103, pp. 395-425.

* cited by examiner

*Primary Examiner* — Bernard E Souw
(74) *Attorney, Agent, or Firm* — O'Shea Getz P.C.

(57) ABSTRACT

Mass spectrometry with lasers generates ions from analyte molecules by matrix assisted laser desorption for a variety of different mass spectrometric analysis procedures. The mass spectrometers with laser systems supply laser light pulses having at least two different pulse durations, and mass spectrometric measuring techniques use the laser light pulses of different durations. The duration of the laser light pulses allows the characteristics of the ionization of the analyte molecules, particularly the occurrence of the ISD (in-source decay) and PSD (post-source decay) types of fragmentation, whose fragment ion spectra supply different kinds of information, to be adapted to the analytic procedure.

11 Claims, 1 Drawing Sheet

LASER SYSTEM FOR MALDI MASS SPECTROMETRY

PRIORITY INFORMATION

This patent application claims priority from German patent application 10 2009 011 653.2 filed on Mar. 4, 2009, which is hereby incorporated by reference.

FIELD OF THE INVENTION

The invention relates to mass spectrometry, and in particular to mass spectrometry with lasers for the generation of ions from analyte molecules by matrix assisted laser desorption for a variety of different mass spectrometric analysis procedures.

BACKGROUND OF THE INVENTION

An important type of ionization for biomolecules is ionization by matrix assisted laser desorption (MALDI), which was developed about 20 years ago by M. Karas and K. Hillenkamp. MALDI ionizes the biomolecules, which are present at high dilution in a mixture with molecules of a matrix substance in samples on sample supports, by firing laser light pulses at them.

MALDI is in competition with electrospray ionization (ESI), which ionizes analyte molecules dissolved in a liquid, and which can therefore easily be coupled with separation procedures such as liquid chromatography or capillary electrophoresis. Although at present more mass spectrometers are equipped with electrospray ion sources than with MALDI ion sources, the development of modern laser and preparation techniques provides MALDI with a number of advantages over ESI. Hundreds of samples can be placed on one sample support. Pipetting robots are available for this purpose. The transport of a neighboring sample on the sample support into the focal point of a UV pulse laser takes a mere fraction of a second; as much time as necessary is then available for the various kinds of analytic methods that may be applied to this sample, limited only by complete consumption of the sample. This distinguishes MALDI from electrospray ionization, which offers slow sample changeover and which, when coupled with chromatography, limits the analysis time to the duration of the chromatographic peak. In addition, MALDI supplies only singly protonated molecule ions even from very heavy analyte molecules, a feature that makes the analysis of biomolecule mixtures easy compared with the wide variety of multiply protonated molecule ions delivered by ESI.

The use of MALDI to analyze peptides that have been separated by liquid chromatography and applied to MALDI sample supports is gaining ground ("HPLC-MALDI"). Also of interest is the use of MALDI in the imaging mass spectroscopy of thin histologic sections, a technique with which the spatial distribution of individual proteins or of specific pharmaceutical agents or their metabolites can be measured. Another application of MALDI is the identification of microbes on the basis of their protein profiles, and this is rapidly gaining popularity due to the high speed of the analysis and the outstanding accuracy of the identifications.

MALDI is particularly well suited to the identification of tryptically digested proteins that are first separated by 2D gel electrophoresis or other methods, and whose separated fractions are then processed to form separate MALDI samples. Suitable robots are available for the processing. The mass spectra of the digest mixtures show almost exclusively singly protonated digest molecules, whose masses can be determined precisely in appropriate mass spectrometers. From this, the original proteins can be determined by commercially available computer programs with the aid of protein databases.

For further characterizations of these digest peptides or other proteins, e.g., in respect of sequence errors or post-translational modifications (PTM), MALDI also offers two methods for generating and measuring the daughter ions of selected parent ions. One method is based on spontaneous fragmentation, for example in-source decay (ISD), which primarily delivers c and z fragment ions, while retaining all the bonds to PTM side-chains. The other method, post-source decay (PSD), in contrast, is based on "ergodic" (or "thermal") fragmentation, which primarily yields b and y fragment ions of the amino acid backbone alone, with the loss of all the side-chains. For the purpose of structural analysis, the ability to acquire both kinds of daughter ion spectra from the same sample is extremely valuable, since a comparison of the two allows both the sequence of amino acids and the positions and masses of the side-chains (PTM) to be read. In addition, MALDI offers the option of further fragmenting ISD fragment ions, whereby the "granddaughter ion spectra" yield information about the structures of specific modification groups, for instance about the polysaccharides of the glycosylations.

In the past, inexpensive UV nitrogen lasers have been used for MALDI. These deliver a laser light pulse lasting a few nanoseconds, and their light beams can be focused by lenses onto a spot of between about 50 and 200 micrometers in diameter. Since, through deliberate adjustment, the "focal spot" on the sample does not correspond to the true focal diameter of the laser light beam, it is better to use the terms "spot" and "spot diameter" here. Nitrogen lasers, however, have a short service life of only a few million laser light pulses, which is a serious obstacle for high-throughput analysis. Solid-state lasers, with a service life that is more than a thousand times longer, are often used, although these require special beam-shaping.

The ions created by each individual laser light pulse are still primarily accelerated axially into a time-of-flight path in MALDI time-of-flight mass spectrometers (MALDI TOF MS) designed specially for this purpose. After transiting the flight path, the ions impinge on a detector that measures the mass-dependent arrival time of the ions and their quantity, and saves the digitized measurements as the time-of-flight spectrum. Repetition frequencies for the laser light pulses were between 20 and 200 hertz, but today MALDI TOF mass spectrometers are available with light pulse frequencies of up to 2 kilohertz. Nowadays, however, time-of-flight mass spectrometers with orthogonal ion injection (OTOF) are also increasingly being equipped with MALDI ion sources, and these record mass spectra at repetition rates of between 5 and 10 kilohertz. In both types of mass spectrometers, detectors for the ion beams are used that include a special secondary electron multiplier (SEM) followed by a transient recorder. The transient recorder contains a fast analog-to-digital converter (ADC), working at between 2 and 4 Gigahertz, usually with only 8-bit resolution. The mass spectra can be up to 100 or even 200 microseconds long, therefore comprising 200,000 to 800,000 measurements. The measurements from several hundreds or thousands of time-of-flight ion spectra measured in sequence in this way are added to form a sum spectrum. This is processed for peak detection, and the list of time-of-flight peaks is converted by a calibration function into a list of the masses m and their intensities i. This list, or its graphical representation i=f(m), is what is referred to as the "mass spectrum". The mass spectra from both types of mass spectrometers can achieve mass resolutions of $R=m/\Delta m=20,000$ to 50,000, where $\Delta m$ is the half-height width of the ion peaks.

Acquiring a mass spectrum typically refers to acquiring hundreds or thousands of individual spectra and combining them into a sum spectrum, as described above. This applies equally to mass spectra from molecule ions and to daughter ion spectra.

When the term "mass of the ions", or simply "mass", is used in connection with ions, it generally indicates the ratio m/z of the mass m to the number z of elementary charges, i.e., the physical mass m of the ions divided by the dimensionless, absolute number z of the positive or negative elementary charges carried by the ion. The rather unfortunate term "mass-to-charge ratio" is often used for m/z, even though it has the dimension of a mass.

Matrix assisted laser desorption uses (with a few exceptions) solid sample preparations on a sample support. The samples include small crystals of the matrix substance mixed with a small proportion (e.g., about a hundredth of a percent) of molecules of the analyte substances. The analyte molecules are individually incorporated in the crystal lattice of the matrix crystals, or are located at the crystal boundaries. The samples prepared in this way are exposed to short UV laser light pulses. The duration of the pulse is usually a few nanoseconds, and depends on the laser being used. This generates vaporization plasma containing neutral molecules and ions of the matrix substance plus a few analyte ions. It is reasonable to assume that, at least in normal protein analysis, the vast majority of analyte ions are formed reactively in the dense plasma by proton transfer from the mostly acid matrix molecules to the analyte molecules. Over a period of a few hundred nanoseconds, the plasma expands into the surrounding vacuum, loses density quickly, and cools adiabatically, as a result of which all the plasma particles are inhibited from further reactions.

The ratio of analyte molecules to matrix molecules is usually one in 10,000 at most, which keeps the analyte molecules apart from each other, and thus dimer ions are not formed. However, the analyte substances can form a mixture in which concentration ratios covering several orders of magnitude may be found between the various analyte substances to be measured. Measuring the analyte molecules then requires the mass spectrometer to have a high dynamic measuring range. Because the dynamic measuring range of each individual mass spectrum recorded by the transient recorder is normally limited to 8 bits, i.e., to measurements extending from 1 to 256, the high dynamic measuring range can only be achieved by recording hundreds or thousands of single mass spectra.

In MALDI mass spectrometry, considerable skill is required to set the detector amplification and the MALDI conditions to optimally exploit the 8-bit dynamic range of the transient recorder without either exceeding this measurement range through oversaturation, or failing to discover a part of the ions as a result of a signal that is too weak. Since the distribution of secondary electrons from single impacts of ions on the secondary electron amplifier forms a Poisson distribution with a mean value of about 2 or 3 electrons, the amplification in the secondary electron amplifier is optimally adjusted if a single ion generates, on average, a signal of about 2.5 counts of the ADC in the transient recorder. The measurement range for ions that reach the detector within the measurement period of the ADC of 0.5 or 0.25 nanoseconds is then 1:100 (2.5 counts:256 counts). Since an ion signal for ions of the same mass extends over several measuring periods, there must not be more than a few hundred ions in an ion signal containing ions of the same mass, and this must be achieved by adjusting the MALDI conditions. Optimal adjustment of the MALDI conditions calls for a great deal of knowledge about the effect of the laser light parameters on the MALDI processes.

The matrix substances employed, including mostly aromatic acids, mean that one of the parameters for the laser light is already largely determined, i.e., the wavelength of UV light. Wavelengths of between 330 and 360 nm, which are well absorbed by the aromatic groups of the best known matrix substances, have proved to be successful. Nitrogen lasers deliver light with a wavelength $\lambda$ of 337 nm, while the most widely used neodymium-YAG lasers have, with frequency tripling, a wavelength $\lambda$ of 355 nm. Pulses of light of both these wavelengths appear to have very much the same effect on the MALDI process. The wavelength of the light and the absorption coefficient of the matrix substance determine the penetration depth of the laser radiation into the solid material of the matrix crystals. The intensity of the radiation as it penetrates the material falls off with a half-value depth of between a few tens and a few hundreds of a nanometer.

In addition to the UV wavelength and the penetration depth, there are three other important parameters that characterize the laser light pulse on the sample:

(1) the total energy of the laser light pulse, normally measured in microjoules (μJ);

(2) the energy density (fluence), which is the energy per unit area in the laser spot (or in multiple synchronously generated laser spots), measured, for instance, in nanojoules per square micrometer (nJ/μm2); and (3) the power density on the surface of the sample, i.e., the energy density per unit of time, which is determined by the length of the laser light pulse. This can, for instance, be measured in nanojoules per square micrometer and nanosecond ($nJ/(\mu m^2 \times ns)$). Our investigations have found the last two of these parameters to be particularly important: laser light pulses containing the same energy but with different durations do not have the same effect at all.

The detailed review article entitled "*The Desorption Process in MALDI*" by Klaus Dreisewerd (Chem. Rev. 2003, 103, 395-425) refers to papers reporting the effects of many parameters such as spot diameter, laser light pulse duration, and energy density on the desorption and the creation of matrix ions and analyte ions. Although the effects of many of these parameters are not independent from one another, hardly ever have all the parameters been carefully varied in relation to one another. It has been reported, for instance, that varying the laser pulse duration between 0.55 and 3.0 nanoseconds does not have any influence on the formation of the ions. The diameter of the spot, however, was not varied or even stated. For varying spot diameters, on the other hand, the threshold of the energy density for the first occurrence of ions has been investigated, yet without examining the profile of the energy density in the laser spot, which, according to our investigations, is of high significance. Moreover, according to this literature source, this threshold rises sharply as the spot diameter becomes smaller For example, a spot diameter of about 10 micrometers, something like 10 times the energy density (fluence) is required as for a spot diameter of 200 micrometers. We cannot confirm this for these spot diameters, even though a rise in the threshold energy density is to be expected for significantly smaller spot diameters, because for tiny spots too much energy can quickly flow away laterally to the surroundings. It appears that little is reported in the literature about how spot diameter and duration of laser pulse affect the kind of ionization, and particularly the fragmentation of the analyte molecules.

Previous investigations of the MALDI process were, however, impaired because the techniques used for preparing the samples were not reproducible. Generally speaking, droplets with dissolved matrix and analyte molecules were simply applied to the sample support plate and dried. These samples were highly inhomogeneous, and it was regularly necessary to search for "hot spots" containing analyte molecules on the sample to analyze these substances. A quantitative approach was out of the question. The majority of investigations of the MALDI process have been made with these samples, and this may explain many of the inconsistencies between these investigations.

In the meantime, it is possible to manufacture highly reproducible thin layers for a number of non-water-soluble matrix substances, such as α-cyano-4-hydroxycinnamic acid (CHCA), including just a single layer of closely packed crystals having a diameter of only about 1 micrometer. A predominantly aqueous solution of analyte molecules is then applied to this dry, thin layer of matrix crystals; the matrix crystals bind the analyte molecules superficially, without themselves dissolving. After about half a minute or one minute, the excess solvent can then be sucked off, which removes many contaminants such as salts. However, a proportion of excess analyte molecules may be removed at the same time, and this must be borne in mind for quantitative investigations. The superficially adsorbed analyte molecules can subsequently be embedded into the matrix crystals, after drying, by applying an organic solvent that begins to dissolve the matrix crystals. Once this solvent has evaporated, an extremely homogeneous sample is obtained. That is, at every location, with small statistical variations, it delivers the same ion currents with the same analytic results. Today, sample carrier plates to which thin layers of CHCA have already been applied are manufactured commercially. Adequate investigations have yet to be published regarding the MALDI processes that take place on these thin layer samples.

The article by Dreisewerd cited above, presents a number of interesting measurement curves. From the first appearance of analyte ions, the yield of analyte ions rises non-linearly over several orders of magnitude with about sixth or seventh power of the energy density of the laser radiation. These measurements, which have been confirmed a number of times, are very interesting. If we assume that the ablation of substance is proportional to the energy density, then the degree of ionization of analyte molecules, and therefore the utilization of the sample, should rise in proportion to this higher power of the energy density. It follows from this that by shrinking the laser spot whilst keeping the total energy of the laser light pulse constant, it should to be possible to increase the yield of analyte ions. Interestingly, this cannot be confirmed for nitrogen lasers, with which the majority of investigations are made. As our own investigations show, the reason for this is that the nitrogen laser does not have a homogeneous energy density profile; rather, in each laser pulse, there is just one, or a few, micro-spots of high energy density, whose position varies from one pulse to the next. When the spot diameter is reduced in size by focusing the laser light beam, the diameter of the micro-spots does not change, as these are at the limit of the focusing capacity of the lens system. The energy density in these micro-spots therefore does not change either. But the micro-spots have diameters that are below the requirement for optimal ion yield.

The situation is different with solid-state lasers. They deliver a smooth energy density profile across the laser spot provided by the lens system. The energy density profile has an approximately Gaussian distribution. The introduction of solid-state lasers into MALDI technology in place of the nitrogen lasers previously used led to the surprising discovery that the smooth beam profile from these solid-state lasers actually reduced the yield of ions from thin-layer preparations. According to our own investigations, the reason for this is that when the energy density is adjusted for optimal utilization of the dynamic measuring range of the ion detector, the ion yield is only a little above the threshold. For this reason, a technique for inhomogeneous beam profiling was developed, which increases the ion yield even beyond the ion yield obtained from nitrogen lasers. See for example, U.S. Pat. No. 7,235,781. It is thus possible to increase the ion yield by optimizing the number and diameter of the laser spots. By profiling the laser beam, a high yield of analyte ions, relative to the original number of analyte molecules on the sample, is achieved at the same time as optimal adaptation to the measuring range of the transient recorder.

SUMMARY OF THE INVENTION

The invention is based on the observation that the power density and the duration of the laser light pulse have a major influence on the type of fragmentation, quite contrary to Dreisewerd's report that the length of laser light pulses between 0.55 and 3.0 nanoseconds have no influence on ion formation.

The invention employs laser systems that supply laser light pulses of different durations in mass spectrometers. A laser system with a continuously adjustable range of laser light pulse lengths is advantageous, but not necessary; a laser system with at least two durations of laser light pulse is sufficient for the purpose.

The durations of the laser light pulses may at least extend from one nanosecond up to three nanoseconds. Even a laser system that supplies two laser light pulses, with durations of around one nanosecond and around three nanoseconds corresponds to the invention. The short laser light pulses with a duration of one nanosecond deliver ISD fragment ion spectra with low sample consumption, while the long pulses have a higher sample consumption, but permit the measurement of PSD daughter ion spectra.

The optimal durations of laser light pulses for the different kinds of processes are not yet known with sufficient accuracy. It may, therefore, be preferable for the short laser light pulses to have a duration of about 0.5 nanoseconds or less. For longer laser light pulses, pulse durations of 5, 8 or 10 nanoseconds deliver good PSD fragment ions. It is to be expected that a laser system that supplies time-modulated laser light pulses, for instance having a high power during the first nanosecond and a lower power in the subsequent nanoseconds, may also be employed. A particular kind of modulation includes delivering two or more laser light pulses in sequence, with an interval of nanoseconds between them.

A wide range of possible embodiments, which will be apparent to a person skilled in the art of lasers, are technically feasible, since laser technology already offers laser systems with variable laser light pulse durations for other applications, although not yet in the nanosecond range. One relatively simple possibility is the use of two laser units, delivering laser light pulses with different durations. It is advantageous if the two lasers can be started synchronously, with only small fluctuations in the start time, in order to generate a time-modulated power density. The two laser units may be incorporated in one housing, and the two laser resonators may be pumped using the same pump system. Pockels cells may be used as Q-switches whose opening times and transparencies can be controlled. Laser light pulses of different durations may also be generated by mode selection, parallel connection of delaying optical waveguides, or by switching between different laser crystals.

For reasons of cost, both research laboratories and routine laboratories for protein analysis of various kinds are often only able to purchase a single mass spectrometer, which must find the most universal use possible. A MALDI time-of-flight mass spectrometer according to an aspect of the present invention therefore represents an optimal solution, particularly since existing mass spectrometers can be modified to use the present invention. For example, it may be possible to convert existing MALDI time-of-flight mass spectrometers into a spectrometer according to this invention by changing the laser system.

These and other objects, features and advantages of the present invention will become more apparent in light of the following detailed description of preferred embodiments thereof, as illustrated in the accompanying drawings.

BRIEF DESCRIPTION OF THE DRAWINGS

The FIGURE is a block diagram illustration of a MALDI time-of-flight mass spectrometer that includes a short-pulse laser and a long-pulse laser.

DETAILED DESCRIPTION OF THE INVENTION

Figure 1:
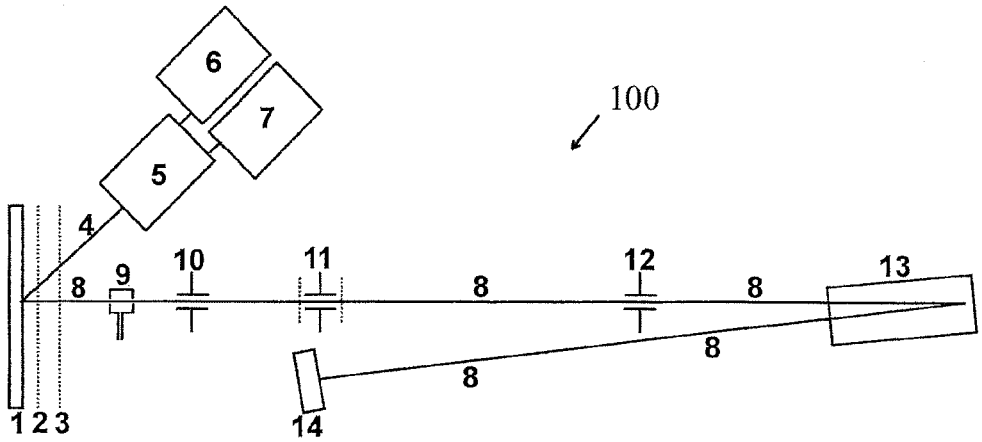

It has been observed that power density and duration of the laser light pulses have an influence on the type of fragmentation and on sample consumption.

According to our observations, a short laser light pulse with a duration of only one nanosecond and with high power density in a matrix substance that is able to release hydrogen radicals will generate a large number of spontaneous ISD fragments from heavy analyte molecules with masses above about 1000 daltons, while consuming a small amount of sample. The spontaneous ISD fragments may be jointly accelerated, and measured as a fragment mass spectrum containing c and z fragment ions. Side chains such as phosphorylations or glycosylations remain bonded in this case. The spot diameter of the laser beam is preferably below 10 micrometers, in order to avoid saturation of the transient recorder. Very heavy analyte molecules above about 15,000 to 20,000 daltons are almost entirely decomposed into fragment ions; their molecule ions can practically no longer be found in the mass spectra. If the laser beam pulse stops after the first nanosecond, it appears that there is no further rise in the internal energy of the molecules, and the instability of the protein ions does not increase any further.

The ISD daughter ion spectra with c and z fragment ions and retention of the side chains, thereby also retaining the post-translational modifications (PTM), contrast with the PSD daughter ion spectra with b and y fragment ions and loss of all the side chains. For the purpose of structural analysis, the ability to acquire both kinds of daughter ion spectra is valuable, since a comparison of the two allows both the sequence of amino acids and the positions and masses of the side-chains (PTM) to be read.

The PSD fragment ions are created by the decomposition of metastable analyte ions, which is caused by a high internal energy taken up in the laser pulse. The decomposition happens during their flight through the flight tubes, after their acceleration in the ion source. The fragment ions created by this decomposition are usually not measured in time-of-flight mass spectrometers with reflectors, because after decomposition they do not have sufficient energy to be focused onto the detector. However, daughter ion spectra resulting from this decomposition of analyte ions can be measured using time-of-flight mass spectrometers specially equipped for the purpose, for example as disclosed in U.S. Pat. No. 6,300,627, which is incorporated by reference. The instability of the analyte ions appears to be generated by a laser light beam lasting more than about one nanosecond: the free molecules and ions of the plasma that is now formed absorb photons from the radiation and thereby increase their internal energy.

For a more detailed structural analysis of ISD fragment ions, and particularly for sequencing the terminal amino acids that are hidden by the background, it may be interesting to make these fragment ions unstable by laser light radiation of longer duration, and to measure the granddaughter ions thus created by metastable decay with a time-of-flight mass spectrometer equipped for recording ergodically generated fragment ions. See for example U.S. Pat. No. 7,396,686, which is hereby incorporated by reference.

The longer duration of the laser light radiation is, however, disadvantageous. In particular, a large amount of the sample material is consumed without raising the yield of ions; in fact the yield is reduced. The plasma appears to be so transparent that deeper and deeper layers of the sample are vaporized. It was even observed that the mass resolution falls with laser light pulses of longer duration, apparently because the well-known ion focusing procedure called "delayed extraction" (DE) is no longer optimally effective.

The invention takes up these observations, and includes using laser systems in the mass spectrometer that supply laser light pulses of different durations, each of which is favorable for different kinds of process. A laser system with continuously adjustable laser light pulse lengths is advantageous, but not necessary; a laser system with two or more durations of laser light pulse is sufficient for most purposes.

The FIGURE illustrates a MALDI time-of-flight mass spectrometer 100 that includes a short-pulse laser 6 and a long-pulse laser 7. Samples are located on a sample support plate 1 opposite accelerating electrodes 2 and 3, and can be ionized by a beam of laser light pulses 4. The two laser units 6 and 7 supply laser light pulses of different lengths, whose beams are shaped into a favorable beam profile by a beam shaping device 5. The ions are accelerated by the accelerating electrodes 2 and 3 to create an ion beam 8, which passes through a gas cell 9 which may, if required, be filled with collision gas, a parent ion selector 10, a daughter ion post-acceleration unit 11 and a parent ion suppressor 12, and is then reflected from the reflector 13 onto the ion detector 14. Each of the samples on the sample support plate 1 are analyzed individually.

If the purpose of the analysis is to determine the sequence of amino acids in a medium-sized protein, the protein must be present in a purified form. It is prepared together with a suitable matrix substance as a sample and applied to the sample support plate 1. A preparation made with 1.5-diaminonaphthalene (DAN), which supports spontaneous ISD fragmentation by readily donating hydrogen radicals, is, for instance, suitable.

In order to generate the ISD fragment ions, the short-pulse laser 6 may be used. This laser generates pulses with a duration of at most about 1 nanosecond and with a high power density. The beam shaping device 5 shapes the beam from this laser into a number of between about 1 and 30 small spots; each spot may have equal diameter of between about three and ten micrometers. The energy, and therefore the power density in the spots, is preferably selected so that the most extensive spontaneous ISD fragmentation possible is achieved. The mass spectrum then shows the c fragment ions in an almost uniformly intense series of ion signals up to a maximum of about 70 amino acids, since all the amino acids, with the exception of proline, cleave with about the same ease. From the C terminal, the z fragment ions allow a sequence of about 50 amino acids at most to be read; the intensities of the z fragment ions are lower than those of the c fragment ions by a factor of between about five and ten. The amino acids may be determined from the spacings in the known way; only leucine and isoleucine cannot be distinguished at all, while glutamine and lysine may only be distinguished with high mass resolution. But here again there are methods for more refined determination. The gap that results from proline's failure to cleave can be closed through the knowledge that proline plus another amino acid must fit here.

If it is important to also distinguish between leucine and isoleucine, then the ISD fragment ions in the ion beam are further fragmented using collision gas in a collision cell 9 by high energy collision-induced dissociation (HE-CID). One ISD fragment ion is then selected in the ion selector 10, and its granddaughter ions are accelerated in the post-acceleration unit 11; they are then measured as a granddaughter ion spectrum with the ion detector 14, following separation in the ion reflector 13. Differences in the intensity of the ion signals in the granddaughter ion spectrum show whether leucine or isoleucine is present.

If unambiguous determination of the amino acid sequence for an ISD fragment ion is disturbed by side chains of an unknown type, or if side chains of a complicated type (glycosylations, for instance) are to be further analyzed, then it is possible to strip all the side chains by ergodic decomposition of one of the ISD fragment ions, induced by increasing the internal molecular temperature. This enables the amino acid chain, and often the type and structure of the side chains, to be definitively determined. This requires a laser light pulse that continues after the first nanosecond, which can be achieved by using the laser 7, which delivers longer laser light pulses. If the energy of the laser unit 7 cannot or should not be set high enough to generate enough ISD fragments in the first nanosecond, then it is also possible to start both laser units synchronously. Synchronous starting of the two laser units with only slight fluctuations (jitter) in the start times of around half a nanosecond is technically possible and is sufficient.

If, on the other hand, the purpose of the analysis is precise determination of the masses of a mixture of digest peptides from tryptic digestion of a relatively large protein, without the mass spectrum being disturbed by spontaneous fragmentation, then the mixture of digest peptides is applied to a thin layer of HCHA, and is prepared as described above. The matrix HCHA largely prevents the formation of ISD fragment ions. The short-pulse laser 6 is now used again, but with a power density that is below the level necessary to form ISD fragment ions. This allows clean mass spectra to be acquired, from which the masses of the ions can be determined. These digest peptide masses can be used to identify the proteins in the known way, using commercially available programs that employ protein sequence databases.

Provided these analyses can be carried out using the short-pulse laser alone, sample consumption is quite low.

If a digest peptide has a mass that cannot be decoded due to one or more unusual modifications that are not contained in the database, then a PSD or a CID fragment ion spectrum can be acquired for this digest peptide. Either the long-pulse laser 7 or the collision cell 9 can be used for this purpose. Both types of daughter ion spectra supply at least parts of the amino acid sequence for unambiguous identification. The side chains of the modifications are detached here. Comparing the two types of daughter ion spectra can even distinguish between leucine and isoleucine.

It is possible to proceed analogously if the masses of proteins or peptides in an unknown mixture are to be determined. If the purpose of the analysis is to acquire a daughter ion mass spectrum of one of the peptides or proteins in the mixture, then the mass spectrometer shown in the FIGURE can again be used. For this purpose, the energy of the long-pulse laser 7 is increased to obtain a larger number of metastable ions for ergodic decomposition. The correct ionic species is then selected by the parent ion selector 10, and its daughter ions are subjected to further acceleration by the post-acceleration unit 11. Those parent ions that have not decomposed are masked out by the parent ion suppressor 12 so that they do not contribute to interfering signals through further decay. The daughter ions are then temporally separated in the ion reflector 13 according to their energies, and reflected onto the ion detector 14. This yields an ergodic type of daughter ion spectrum, i.e., one containing b and y fragment ions, as are also familiar from collision fragmentations.

The two laser units 6 and 7 do not have to be in separate housings. For example, they can be located in a single housing together with the beam shaping device 5, and it may even be possible for the two laser crystals to be pumped by a single diode pumping unit.

In addition, there are various techniques for altering the pulse duration of solid-state lasers. One particular technique for generating a short and a long laser light pulse in a single laser unit includes generating either an individual laser light pulse with a duration of about one nanosecond or less, or generating at least two such individual laser light pulses, one after the other. These can be created at an interval in the order of nanoseconds, and constitute a special case of a modulated laser light pulse. The first laser light pulse creates the plasma, and is by itself sufficient for all types of analysis that do not require the ions to have high internal energy. If it is necessary to increase the internal energy of the analyte ions in order to generate ergodic decomposition, then the laser light pulse that includes two or more individual laser light pulses may be used.

If it is possible to design a laser system whose size is similar to that of existing laser systems, then it is possible to exchange the laser in deployed mass spectrometer to take advantage of the present invention. In this way the range of application is extended.

The description above refers to time-of-flight mass spectrometers with axial ion injection. However, MALDI ion sources may also be used with other types of mass spectrometer; for example, ion cyclotron resonance mass spectrometers (ICR-MS), ion trap mass spectrometers (IT-MS) or time-of-flight mass spectrometers with orthogonal ion injection (OTOF-MS). The ion sources for these mass spectrometers may also benefit from the present invention.

Since these mass spectrometers use ion guide systems to feed the ions from the ion sources to the analyzers, it should be remembered that metastable decay will take place to a large extent in these ion guides. The ions remain within these ion guides for periods extending from hundreds of microseconds up to milliseconds. Thus, by selecting the matrix substance and the duration of the laser pulse, both electron-induced fragments and ergodic fragments from a purified analyte substance can be measured. A short-pulse laser in combination with a suitable matrix substance can be an outstanding source of ISD fragment ions for acquiring an ISD fragment ion spectrum. Using the same analyte in combination with a suitable matrix substance, a long-pulse laser yields metastable ions, which decompose within the transfer section and can be measured as an ergodic fragment ion spectrum.

The present invention may use lasers of other wavelengths, such as IR lasers.

Although the present invention has been illustrated and described with respect to several preferred embodiments thereof, various changes, omissions and additions to the form and detail thereof, may be made therein, without departing from the spirit and scope of the invention.

What is claimed is:

1. A mass spectrometer, comprising a laser system that ionizes analyte molecules by matrix assisted laser desorption, where the laser system provides a plurality of laser light pulses of different durations and where the laser system delivers both a laser light pulse with a maximum duration of about one nanosecond, whose pulse duration and power is suited to the generation of spontaneous ISD (in-source decay) fragment ions of the analyte molecules, and also deliver a laser light pulse with a duration of at least three nanoseconds, whose pulse duration and power is suited to the generation of spectra of ergodic PSD (post-source decay) fragment ions.

2. The mass spectrometer of claim 1, where the shortest laser light pulse is less than about one nanosecond in length.

3. The mass spectrometer of claim 1, where the longest laser light pulse is greater than at least three nanoseconds in length.

4. The mass spectrometer of claim 1, where the laser system supplies laser light pulses with two different, fixed pulse durations.

5. The mass spectrometer of claim 4, where the laser system comprises two lasers.

6. The mass spectrometer of claim 1, where the laser system supplies laser light pulses with pulse durations that are adjustable, either continuously or in discrete steps.

7. The mass spectrometer of claim 1, where the laser system delivers laser light pulses whose power is time-modulated.

8. The mass spectrometer of claim 1, where the laser system delivers laser light pulses that comprise either a single pulse or at least two successive individual pulses.

9. A method for ionization of the analyte molecules by matrix assisted laser desorption in a mass spectrometer with a laser system, comprising automatically adjusting the laser system to deliver both a laser light pulse with a maximum duration of about one nanosecond, whose pulse duration and power is suited to the generation of spontaneous ISD (in-source decay) fragment ions of the analyte molecules, and also deliver a laser light pulse with a duration of at least three nanoseconds, whose pulse duration and power is suited to the generation of spectra of ergodic PSD (post-source decay) fragment ions.

10. The method of claim 9, where the laser system is adjusted to deliver short laser light pulses with a duration of less than about one nanosecond for spontaneous fragmentation of the analyte molecules, and to deliver longer laser light pulses with a duration of at least three nanoseconds for the generation of metastable analyte ions.

11. The method of claim 9, wherein the longer laser light pulses comprise a series of at least two individual light pulses.

* * * * *

UNITED STATES PATENT AND TRADEMARK OFFICE

CERTIFICATE OF CORRECTION

PATENT NO. : 8,110,795 B2
APPLICATION NO. : 12/716813
DATED : February 7, 2012
INVENTOR(S) : Haase et al.

It is certified that error appears in the above-identified patent and that said Letters Patent is hereby corrected as shown below:

On the front page:

Item 73 in the "Assignee", please delete "Brucker Daltonik GmbH" and insert --Bruker Daltonik GmbH--.

Signed and Sealed this
Twenty-fourth Day of April, 2012

David J. Kappos

David J. Kappos
*Director of the United States Patent and Trademark Office*